United States Patent [19]

Ostermann et al.

[11] 4,189,813

[45] Feb. 26, 1980

[54] METHOD FOR MANUFACTURING SINGLE STAGE GEARED TURBINES

[75] Inventors: Gerd Ostermann, Nüremberg; Erwin Stiegler, Feucht; Erich Schliermann; Peter Hirsch, both of Nüremberg, all of Fed. Rep. of Germany

[73] Assignee: AEG-Kanis Turbinenfabrik GmbH, Nuremberg, Fed. Rep. of Germany

[21] Appl. No.: 804,016

[22] Filed: Jun. 6, 1977

[30] Foreign Application Priority Data

Jun. 4, 1976 [DE] Fed. Rep. of Germany ..... 2625903

[51] Int. Cl.[2] ..... B23P 15/00

[52] U.S. Cl. ..... 29/156.8 R; 29/428; 415/DIG. 3

[58] Field of Search ..... 29/156.4 R, 428, 429, 29/430, 156.8 R; 415/122 R, DIG. 3

[56] References Cited

U.S. PATENT DOCUMENTS

| | | | |
|---|---|---|---|
| 3,079,605 | 2/1963 | Thomas et al. | 415/122 R |
| 3,131,877 | 5/1964 | Budzien | 415/122 R |
| 3,761,205 | 9/1973 | Cronstedt | 415/122 R |
| 3,809,493 | 5/1974 | Pilarczyk | 415/122 R |
| 3,914,842 | 10/1975 | Bruckhoff et al. | 29/156.4 R |
| 4,018,544 | 4/1977 | Eberhardt | 415/122 R |

FOREIGN PATENT DOCUMENTS

| | | | |
|---|---|---|---|
| 560357 | 10/1923 | France | 415/122 R |
| 1440821 | 6/1976 | United Kingdom | 415/DIG. 3 |

*Primary Examiner*—Daniel C. Crane
*Attorney, Agent, or Firm*—Spencer & Kaye

[57] ABSTRACT

A series of standardized components from which can be assembled a single stage geared turbine having any one of a large number of combinations of output power and gear rotation rate, the components including a plurality of rotor wheels having respectively different wheel pitch diameters, a plurality of steam delivery nozzle sets for each rotor wheel, a plurality of turbine casings each dimensioned to correspond to a respective wheel pitch diameter, a plurality of gear casings each dimensioned to correspond to a repectively different value for the spacing between the axis of a pinion and a gear, and a plurality of pinions having respectively different diameters, any gear casing being connectable to any turbine casing, the turbine casing employed for the turbine to be assembled being selected on the basis of the rotor wheel which has been selected, and the gear casing which is to be employed in the turbine being selected on the basis of the distance between the axes of rotation of the selected pinion and the output gear.

13 Claims, 6 Drawing Figures

FIG. 4

| NOTE REGARDING GT... / 30 00 | |
|---|---|
| AA < AA OPT | POSSIBLE AS LONG AS HORIZ. LIMITATION (N/n) OR RIGHT-HAND LIMITING CURVE (N) IS NOT EXCEEDED |
| AA > AA OPT | POSSIBLE W/ LARGER PINION DIAMETER; NOT POSSIBLE WITH THE SAME PINION DIAMETER (n) |

| GROUP | PINION | (GEAR) WHEEL |
|---|---|---|
| * 1 HARD | 31 Cr Mo V9 | 31 Cr Mo V9 |
| ** 2 HARD/SOFT | 31 Cr Mo V9 | 42 Cr Mo 4 |
| *** 3 SOFT | 34 Cr Ni Mo 6 | 42 Cr Mo 4 |

| IDENTIFICATION | C | D | E |
|---|---|---|---|
| PINION DIAM | 160 | 200 | 250 |
| I AT AA 360 mm | — | — | — |
| 400 mm | 3.809 | 2.831 | 2.183 |
| 450 mm | 4.426 | 3.322 | 2.592 |
| 500 mm | 5.021 | 3.797 | 2.986 |
| 550 mm | 5.745 | 4.373 | 3.465 |
| 630 mm | 6.596 | 5.051 | 4.028 |

AXIAL SPACING 360 NOT FEASIBLE FOR TYPE GT 63 FOR STRUCTURAL REASONS

DESIGN-DEPENDENT AXIAL SPACING VARIATIONS

OUTPUT LIMITED BY MAXIMUM PERMISSIBLE RADIAL BEARING LOAD

MOMENT LIMITED BY MAXIMUM PERMISSIBLE TOOTH BASE LOAD WITH SHORT-CIRCUITED GENERATOR

BLOCKING RANGE FOR GENERATOR DRIVE

MOMENT LIMITED BY MAXIMUM PERMISSIBLE LOAD ON TOOTH SIDES FOR GROUP 1*

MOMENT LIMITED BY MAXIMUM PERMISSIBLE LOAD ON TOOTH SIDES FOR GROUP 2*

MOMENT LIMITED BY MAXIMUM PERMISSIBLE LOAD ON TOOTH SIDES FOR GROUP 3*

MOMENT LIMITED BY MAXIMUM PERMISSIBLE TORSION STRESS ON THE WHEEL SHAFT

NUMBER OF REVOLUTIONS LIMITED BY MAXIMUM PERMISSIBLE PITCH LINE VELOCITY

*MOMENT LIMITATION DUE TO MAXIMUM PERMISSIBLE PINION SHAFT BENDING APPLIES ONLY FOR THE SMALLEST PINION OF TYPE GT40

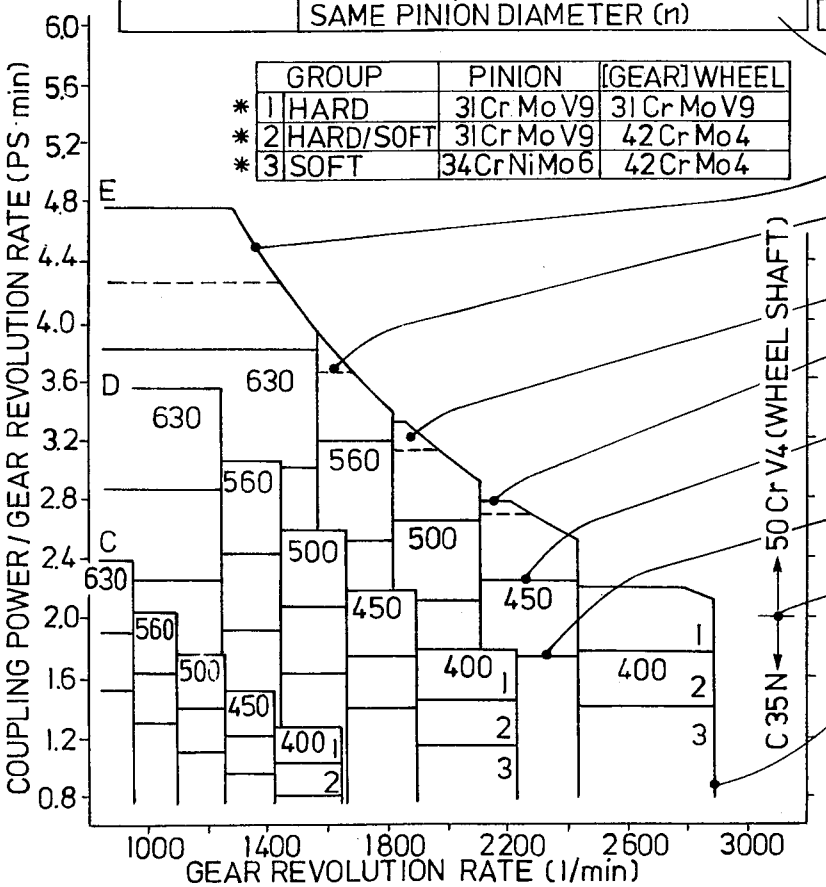

METHOD FOR MANUFACTURING SINGLE STAGE GEARED TURBINES

BACKGROUND OF THE INVENTION

The present invention relates to single stage geared turbines of the type which has a rotor wheel of the Curtis type coupled to the pinion shaft of the associated gear.

Turbines of this type are used in a variety of situations, one notable example being main propulsion marine turbines.

SUMMARY OF THE INVENTION

It is an object of the invention to improve such assemblies which include a turbine and associated gears, in particular by substantially reducing the components and groups of components, such as the turbine rotors, blades, nozzles, turbine and gear casings as well as pinions, pinion shafts, bearings and shaft seals for the gears for producing the output power and revolution rate required for a particular application, and thus to simplify assembly and manufacturing procedures, thereby decreasing total production costs.

These and other objects according to the invention are achieved by practice of a novel method for assembling a single stage geared turbine composed of a turbine casing, an assembly within the casing including a set of steam delivery nozzles and a rotor wheel provided with buckets and defining an impulse turbine stage of the Curtis type, a gear casing in which the turbine casing is overhung mounted, a gear rotatably mounted in the gear casing, and a pinion mounted for rotation with the turbine stage and drivingly engaging the gear, for operation at a selected power and gear rotation rate. The novel method according to the invention is carried out by providing a plurality of rotor wheels having respectively different wheel pitch diameters and corresponding maximum rated powers and each having a rated speed inversely proportional to its associated pitch diameter and optimally corresponding to the maximum rated power associated with its high velocity ratio, an uniform blading being associated with each wheel of a given pitch diameter, providing a plurality of steam delivery nozzle sets for each rotor wheel, each nozzle being dimensioned with variable, opening ratio $F_{min}/(txh)_{nozzle}$ in order to adapt it in each case to the at least required reaction depending on the parameters and the throughput of steam, providing a plurality of turbine casings each dimensioned to correspond to a respective wheel pitch diameter, associating that one of the rotor wheels whose rated power corresponds to the selected power with that related nozzle set to form a selected turbine stage assembly, mounting the resulting turbine stage assembly in that turbine casing which corresponds to the wheel pitch diameter of the selected assembly, providing a plurality of gear casings each dimensioned to correspond to a respectively different value for the spacing between the axes of a pinion and a gear, providing a plurality of pinions having respectively different diameters staggered according to a standard series, selecting that one of the pinions which corresponds to the selected power and the rated power/speed ratio of the selected turbine stage assembly, selecting a gear dimensioned in accordance with the selected pinion and selected rotor wheel rated speed to produce a selected gear rotation rate, selecting that one of the gear casings which is dimensioned to correspond to the spacing between the axes of the selected pinion and gear, and mounting the selected pinion and gear in the selected casing in power transmitting engagement with one another and connecting the selected pinion to rotate with the selected turbine stage assembly.

According to a preferred embodiment of the invention, there is provided, for each wheel pitch diameter, a plurality of rotor wheels having respectively different velocity ratios lower than the optimum velocity ratio. According to a particularly advantageous embodiment of the invention, all rotor wheels have the same blade profile in their first row of buckets, except for the bucket blade profiles in the border regions at the beginning and end of the corresponding output power range.

The present invention permits achievement of a substantial standardization of the components and groups of components of a series of such turbines, permitting each model of the series to be manufactured substantially independently of orders at hand in economic, small production runs and to keep a corresponding stock of these models on hand. On the other hand, it is possible to meet all the applicable requirements of international classification companies, for example Lloyds Register.

The steam portion of each turbine of the series is substantially defined by the turbine rotor wheel pitch diameter, or mean diameter, i.e. the diameter at the center lines of the steam delivery nozzles. The pitch diameter determines the maximum input-output for the particular turbine size. Each rotor wheel pitch diameter value is associated with a certain value for the maximum rated peripheral speed $U_1$, the peripheral speed being that occurring at the pitch diameter, and the rates of rotation of rotor wheels having different pitch diameters are staggered in accordance with the respective pitch diameters in a manner to cause all of the rotor wheels to have approximately the same peripheral speed.

Thus, if the same type of blading at least for the first row of buckets is used for all turbine sizes, approximately the same maximum ratio $U_1/V_{01}$, where $V_{01}$ is the velocity corresponding to total state available energy, is produced for all rotor wheel pitch diameters and has approximately its optimum value.

In each turbine of the series, the steam delivery nozzles are dimensioned in order to produce proper adaptation to the steam parameters and the throughput quantity, corresponding to the assigned rated output. The turbine stage of each such turbine is of the impulse type, where the entire pressure drop is across the steam delivery nozzles, and is constituted by a Curtis-type stage having one to three rows of buckets.

Preferably the selected nozzles are dimensioned to have an opening ratio $F_{min}/(t.h)_{nozzle}$, in each case, adapted at least to the minimum required reaction, so that the blade lengths may remain constant throughout the rated power range.

The procedure in practice is to standardize the blades of the various units for certain preferably by 20% staggered values for the high speed ratio $U/V_0$, which values are each time the said 20% less beginning from the optimum high speed ratio value, so as to cover the output range even with extremely large variation in total enthalipy drop of the stages, since all possible driven speeds for the gear assembly are additionally to be covered with as few variations in the gear assembly as possible. The blade profiles of the first bucket row are the same for all turbine rotor wheels, which are all of the single, two or three row Curtis design.

The turbine rotor wheels are releasably coupled by means of mechanical connecting devices to the pinion shaft of a gear assembly. The connecting dimensions for fastening the pinion shaft to the rotor wheels are standardized so that any turbine rotor wheel can be combined with any pinion shaft. Turbine and gear casing are connected through raised connecting flanges having distances of the bores for the connection bolts, etc., which are also uniform for all turbine gear casings.

In order to cover the required output range, pinions having pitch diameters staggered according to a standard series are provided at the gear side, the diameters of the pinion shafts increasing in a manner corresponding approximately to the increases of the pitch diameters of their respective pinions. Additionally, all pinions have uniform teeth so that tool attachment angle and angle of inclination, diametral pitch, shifted profile and standard profile are always the same. However, not all pinions are combined with all turbines or turbine rotor wheels, respectively. According to the respective output values, the highest turbine outputs are assigned the largest pinion diameters and the smallest turbine outputs are assigned the smallest pinion diameters. It may happen that overlapping occurs in these assignments, but the largest pinion assigned to a particular turbine model size is always provided for the maximum rated turbine output.

An approximately equal number of gears is associated with each of the pinions, the tooth geometry being selected so that the combinations of the pinion with one particular gear always result in a certain fixed spacing between the axes of the contacting pinion and gear. This results in a considerable limitation of the required number of gear casings which corresponds to the number of gears per pinion. Due to the described staggering in the turbine output powers and speeds as well as pinion diameters and spacings between pinion and gear axes, the resulting theoretical driving speeds are staggered for every output value in the required range. In selecting the suitable turbine-gear assembly combination for a particular purpose, it will generally be best to proceed so that the driven speed corresponds as closely as possible to the maximum rated turbine speed, and to then correspondingly select the appropriate pinion for the output range in question, i.e. the exact pinion diameter, the most favorable spacing between gear and pinion axes and thus the gear casing corresponding to this spacing.

BRIEF DESCRIPTION OF THE DRAWING

FIG. 2 is a detailed cross section of two nozzles, taken on its pitch diameter, showing the flow channel between them;

FIG. 4, is a diagram showing the method and being the base of gear selection.

DESCRIPTION OF THE PREFERRED EMBODIMENTS

Figure 1:
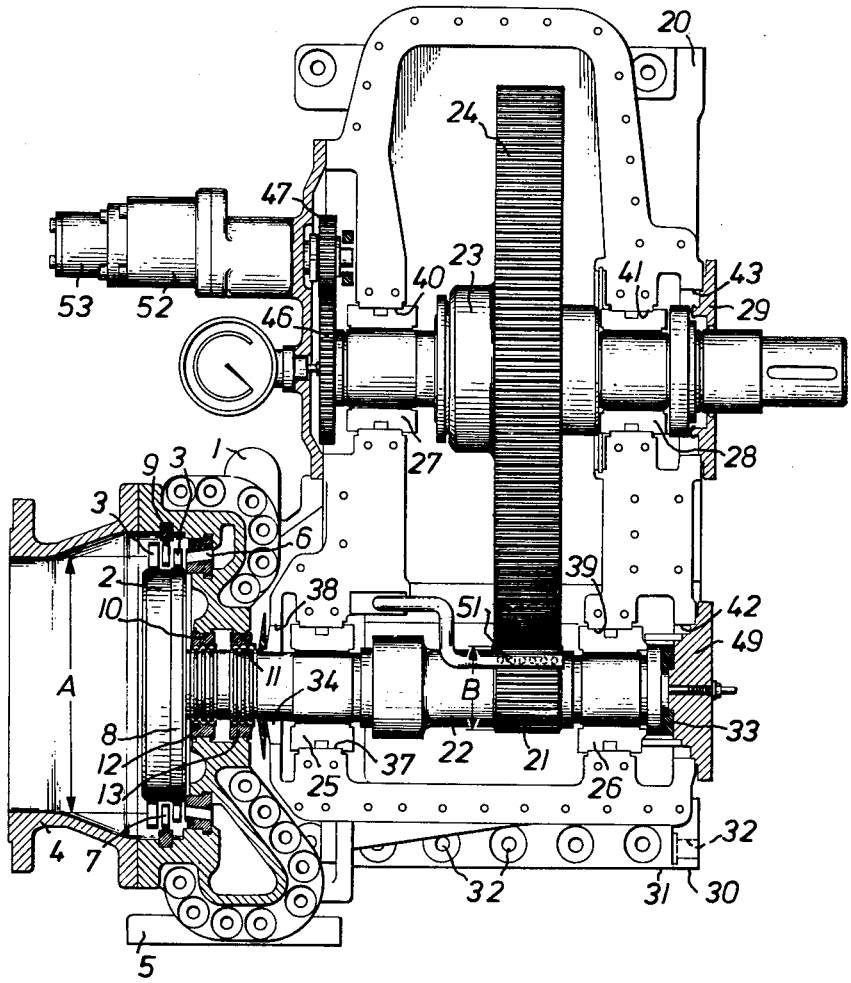
FIG. 1, showing the turbine-gear-unit, is partially a plan view of the gear taken on its (horizontal) central housing flange and partially a corresponding cross sectional view of the turbine housing.

The present invention will now be further described in detail with reference to a preferred embodiment as shown in FIG. 1 in which two-row ($C_2$) Curtis stages of nozzles 6, stationary blades 7 and rotating blades 3 are used exclusively.

Preferably a particular turbine rotor wheel diameter "A" and correspondingly an associated uniform turbine casing 1 are provided for every approximately 2000 HP increase in output, i.e., for example three sizes up to the possibly required approximately 6500 HP maximum output. On the gear side three different pinions 21 are available per size of wheel 2 or turbine respectively, but no more than a total of 5 to 6, with staggered pitch diameters "B" and thus also staggered translatable power, for example according to the standard series R 10, according to DIN 323 (see table 1).

By constant fitting diameter of flange 8 each turbine wheel 2 can be fixed to each of the pinion shafts 22 which carry the turbine wheel in an overhung manner.

Thus the in maximum power rating succeeding turbine has, for example, two pinion diameter stages in common with its preceding turbine or what means the same rotor wheel size, respectively, but, as already mentioned, each pinion diameter is associated with a different turbine speed. Each pinion 21 can engage any one of 6 gear wheels 24 having such pitch diameters that the same number of spacings AA between axes of the wheel shafts 22 and 23, i.e. 6, results, see values of pitch diameters in TABLE 2.

TABLE 1

| pinion pitch diameter | "B" mm | 100 | 125 | 160 | 200 | 250 |
|---|---|---|---|---|---|---|
| rated power | ps | | | | | |
| GT 40 | | 685 | 1915 | 2690 | — | — |
| GT 50 | | — | 1615 | 2400 | 4380 | — |
| GT 63 | | — | — | 1890 | 3945 | 6550 |
| | "DA" | | driven speed [rpm] | | | |
| turbine type | 360 | 1657 | 2215 | 2994 | | |
| (wheel pitch | 400 | 1472 | 1958 | 2625 | | |
| diameter/ | 450 | 1283 | 1697 | 2259 | | |
| speed[rpm]) | 500 | 1142 | 1504 | 1992 | | |
| GT40 | 560 | — | 1321 | 1741 | | |
| (400/10000) | 630 | — | 1156 | 1516 | | |
| | 360 | | 1772 | 2395 | 3255 | |
| | 400 | | 1566 | 2100 | 2826 | |
| GT 50 | 450 | | 1358 | 1808 | 2408 | |
| (500/8000) | 500 | | 1203 | 1593 | 2107 | |
| | 560 | | 1057 | 1393 | 1829 | |
| | 630 | | 925 | 1213 | 1584 | |
| | 360 | | | — | — | — |
| | 400 | | | 1654 | 2225 | 2886 |
| GT 63 | 450 | | | 1423 | 1896 | 2431 |
| | 500 | | | 1255 | 1659 | 2110 |
| (630/6300) | 560 | | | 1097 | 1441 | 1818 |
| | 630 | | | 955 | 1247 | 1564 |

TABLE 2

| GEAR | mm | gear wheel pitch diameter | | | | | Dim. |
|---|---|---|---|---|---|---|---|
| | 360 | 620 | 595 | 560 | 520 | — | mm |
| distances of | 400 | 700 | 675 | 640 | 600 | 550 | mm |
| gear axes | 450 | 800 | 775 | 740 | 700 | 650 | mm |
| "AA" | 500 | 900 | 875 | 840 | 800 | 750 | mm |
| | 560 | — | 995 | 960 | 920 | 870 | mm |

TABLE 2-continued

| | | | | | | | |
|---|---|---|---|---|---|---|---|
| | 630 | — | 1125 | 1100 | 1050 | 1010 | mm |
| | | ↑ | ↑ | ↑ | ↑ | ↑ | |
| pinion pitch diameter "B" | | 100 | 125 | 160 | 200 | 250 | mm |
| TURBINE | | | | | | | |
| | | ↖↗ | ↗↙ | ↑↑ | ↖↙ | ↖↗ | |
| wheel pitch diameter "A" | | 400 | | 500 | | 630 | mm |
| blade width | | 9 | 16 | 11,2 | 20 | 14 | 25 mm |
| live steam | nom. size | 100 | 150 | 150 | 200 | 150 | 250 mm |
| | nom.press. | 160 | 64 | 160 | 64 | 160 | 64 atgg |
| exhaust steam | nom. size | 300 | 400 | 400 | 500 | 500 | 600 mm |
| | nom. press. | 25 | 16 | 25 | 16 | 25 | 16 atgg |

By thus standardizing the dimensions of the bores 37 to 43 intended to accommodate bearings 25 to 28 and shaft seals 34 and 29 and all fixed axial dimensions determining the mutual axial association of components, such as seals and bearing cups arranged on or around the pinion shaft 22 as well as their position and the position of the pinion shaft 22 with respect to the casing 20 for all pinion shafts and gear casings, it is possible to limit the total number of gear casings required to six.

In order to be able to combine each gear casing 20 with all turbine casings 1, the connecting dimensions for the connecting flanges between gear casing 20 und turbine casing 1 are also standardized.

In toto, the series of units in the embodiment in question offers a selection of 54 different theoretical driving speeds for the gear assembly, 18 for each turbine size. Of course the associated power regions based on the rotor wheel diameters according to the difference of the latter ones are also different. The blade profiles are standardized not only for the optimum high speed ratio $U/V_0$ but also for two ranges thereof each appr. 20% less than the preceding so as to be able to stay within the breaking strength limits of the material of the rotating parts in the face of large and very large pressure drops at great and very great drops of enthalpy in stages. For the same reasons, two blade widths are available for each rotor wheel diameter stage, i.e. for the larger diameter stages.

Figure 2A:
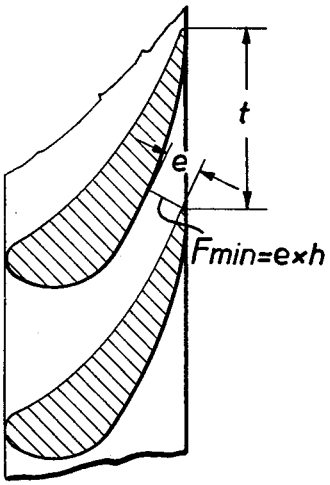
FIG. 2*a*, is a detailed cross section of two nozzles, showing the flow channel between them.
Figure 2B:
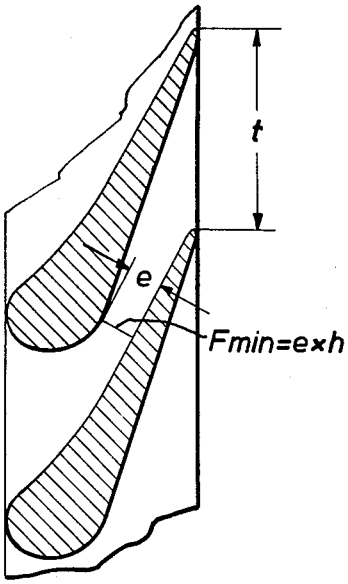
FIG. 2*b*, is a similar view for nozzles with an extension ration where the throat area $F_{min}$ is situated before the end of the flow channel.
Figure 3:
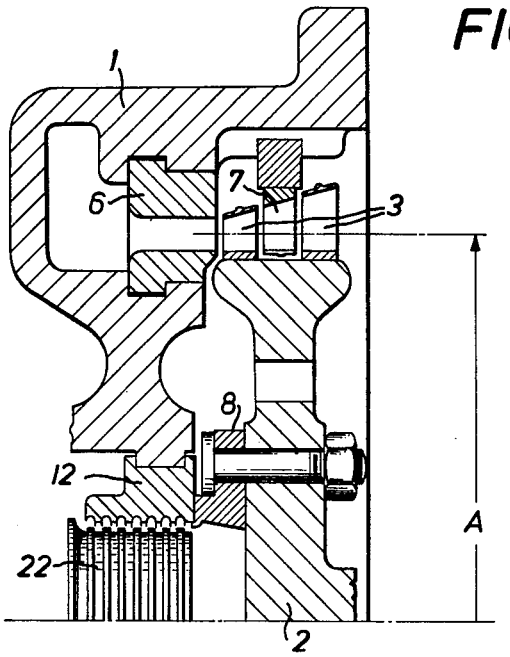
FIG. 3, is an enlarged partially cross sectional view of the turbine casing and rotor wheel.

This makes it possible to exactly meet any required power and speed, or combinations thereof, within the power range of 350 to about 6500 HP and speed range of about 1000 to about 3250 rpm under consideration. As mentioned before this is effected with a minimal variety of blades, especially different blade profiles, see table 2. There is no alteration of the blade lengths necessary and provided, but instead the minimum required reaction is effected by adaptation of the nozzles, FIG. 2*a*, especially in its value of opening ratio $F_{min}/(hxt)_{nozzle}$, wherein $F_{min}$ means the minimal throttling cross section in sq. in., h the height of the nozzles and t the pitch at mean diameter in in.; or if the nozzle needs a certain rate of extension, (FIG. 2*b*) also this is adapted.

This needs no further explanation because the method of nozzle adaption and, generally speaking, dimensioning is well known to those skilled in the art of steam turbine construction.

Figure 5:
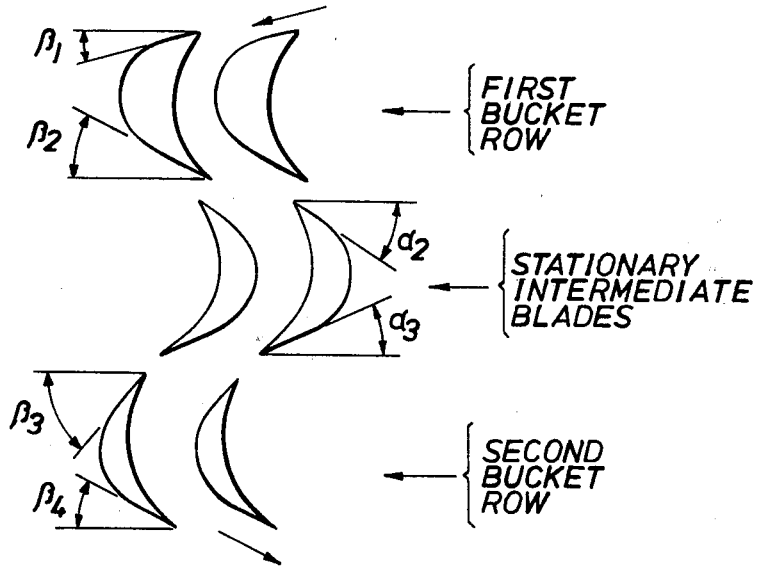
FIG. 5 is a developed pictorial view of a portion of one embodiment of a blade assembly provided in a turbine unit according to the invention.

FIG. 5 illustrates a portion of several blades of one embodiment of a turbine stage according to the invention, the directions of steam flow at the inlet and outlet sides being indicated by arrows. The various blade angles shown can have the following values:

First bucket row: $\beta_1=\sqrt{}^{\circ}$; $\beta_2=24^{\circ}$

Stationary blades: $\alpha_2=38^{\circ}$; $\alpha_3=31^{\circ}$

Second bucket row: $\beta_3=42^{\circ}$; $\beta_4=35^{\circ}$, or $\beta_3=45^{\circ}$; $\beta_4=39^{\circ}$, or $\beta_3=48^{\circ}$; $\beta_4=42^{\circ}$.

The blade profiles are selected to produce low reaction and to be suitable for a wide range of Mach numbers.

The radial bearings 25 to 28 are designed for the respective maximum power. Further the power limitations of the individual gears are the result of known influences on the stability of the tooth edges, tooth base stress and the transverse bending strength of the pinion 21 as well as the pitchline velocity.

Wheel shafts 23 having two diameters staggered according to power and associated combined radial and thrust bearings 28 serve for supporting the gear wheels 24 which mesh with the pinions 21. The outer diameters of the thrust bearings 33 of the pinion shafts 22 are staggered in correspondence with the differing stresses to which they are subjected.

An opportunity for variation is provided, on the turbine side, for the live steam intake duct 5 and the steam exhaust 4 so as to attain the appropriate ratio between the passage cross sections for the various live steam delivery pressure and exhaust pressure as well as the throughput quantities. There are two live steam intake ducts available for association with each rotor wheel diameter stage, staggered by standard diameter widths and pressures, the higher diameter stage belonging to the lower pressure stage, in this case 64 atmospheres gauge. Two standard diameter widths are also available for the steam exhaust, 4, s.TABLE 2

The turbine casings 1 themselves are likewise very uniform for each rotor wheel diameter stage, for example, with regard to the dimensions of the shaft recesses 9 to 11 required, for example, to accomodate the nozzle rings 6 and the labyrinth seals 12 and 13.

Further measures for standardization are the design of the turbine and the gear assembly for horizontal as well as vertical orientation by flanges 31 and 30 of the gear housing and corresponding bores 32 for the bolts without incurring the danger of the formation of a water sack in the turbine; and the provision of oil through a feeder pipe (not shown) formed during casting of the housing parts to extend in parallel with the pinion shaft 22 and to open into every bearing seat as well as the oil sprinkler 51 for the gear wheels 21 and 24.

Furthermore, the thrust bearing 33 associated with the pinion 21 is replaceable without requiring removal of the gear housing cover. Simultaneously, that bearing may be supplied with fresh oil centrally through its rigid supporting flange 49. In order to permit starting under full exhaust pressure, or to absorb greater axial forces, a pressure oil release is provided for the thrust bearing 33.

By a tandem arrangement of oil pump 52 and governor 53, both driven by the same connecting gear 46, 47 via the rotor wheel shaft 23, an auxiliary drive for the governor at the pinion shaft 22 can be eliminated.

It will be understood that the above description of the present invention is susceptible to various modifications, changes and adaptations, and the same are intended to be comprehended within the meaning and range of equivalents of the appended claims.

We claim:

1. In a method for assembling a single stage geared turbine composed of a turbine casing, an assembly within the casing including a set of steam delivery nozzles and a rotor wheel provided with buckets and defining an impulse turbine stage of the Curtis type, a gear casing in which the turbine casing is overhung mounted, a gear rotatably mounted in the gear casing, and a pinion mounted for rotation with the turbine stage and drivingly engaging the gear, for operation at a selected power and gear rotation rate, the improvement wherein said turbine is formed by selecting said rotor wheel from a small number of rotor wheels having respectively different wheel pitch diameters and corresponding maximum rated powers differing by about 2000 HP between successive diameters and each having a rated speed inversely proportional to its associated pitch diameter and optimally corresponding to the maximum rated power relative to its high velocity ratio, a uniform blading being associated with each wheel of a given pitch diameter and, except for the bucket blade profiles in the border regions at the beginning and end of the corresponding output power range, all rotor wheels having the same blade profile configuration in their first row of buckets, and said rotor wheels having associated rated speed values such that all rotor wheels have substantially the same optimum velocity ratio, the selected rotor wheel having a maximum rated power corresponding to the selected power at which said turbine operates; selecting said set of steam delivery nozzles from a plurality of steam delivery nozzle sets for the selected rotor wheel, each nozzle being dimensioned with variable opening ratio $(F_{min}/txh)_{nozzle}$ in order to adapt it in each case to the at least minimum required reaction depending on the parameters and the throughput of steam, the selected nozzle set having an opening ratio providing the minimum required reaction; assembling the selected rotor wheel with the selected nozzle set to form a selected turbine stage assembly; selecting a turbine casing from a plurality of turbine casings each dimensioned to correspond to a respective wheel pitch diameter, the selected turbine casing corresponding to the diameter of the selected rotor wheel; mounting the selected turbine stage assembly in the selected turbine casing; selecting a gear casing from a plurality of gear casings each dimensioned to correspond to a respectively different value for the spacing between the axes of a pinion and a gear; selecting a pinion from a plurality of pinions having respectively different diameters staggered according to a standard series, the gear casing dimensions differing between gear casings in steps approximately equal in number to the number of different pinion diameters so that all possible pinion/gear casing combinations yield a number of gear output speeds extending over the entire range of desired gear rotation rates and the entire desired rated power range, the pinions of larger diameter being provided for the rotor wheels having the higher rated powers, the pinions of smaller diameter being provided for the rotor wheels having the lower rated powers, and a respective group of pinions being provided for each rotor wheel having a rated power in the medium range; selecting that one of the pinions which is provided for the selected rotor wheel and which corresponds to the selected power and the rated power/speed ratio of the selected turbine stage assembly; selecting a gear dimensioned in accordance with the selected pinion and selected rotor wheel rated speed to produce the selected gear rotation rate; the selected gear casing being dimensioned to correspond to the spacing between the axes of the selected pinion and gear; and mounting the selected pinion and gear in the selected casing in power transmitting engagement with one another and connecting the selected pinion to rotate with the selected turbine stage assembly.

2. A method as defined in claim 1 wherein the small number of rotor wheels from which said rotor wheel is selected comprises, for each wheel pitch diameter, a plurality of wheels each having a respectively different bucket blade width, and that rotor wheel is selected whose bucket blade width corresponds most closely to the selected power and required rotor wheel speed.

3. A method as defined in claim 1 wherein the small number of rotor wheels comprises, for at least one pitch diameter, one rotor wheel having approximately the optimum velocity ratio and a plurality of further rotor wheels having respectively different velocity ratios lower than the optimum velocity ratio, the velocity ratios of the further wheels differing from one another in steps.

4. A method as defined in claim 3 wherein, for each pitch diameter, three such wheels are provided, each having a velocity ratio differing by about 20% from the preceding, beginning from the optimum velocity ratio.

5. A method as defined in claim 1 wherein each rotor wheel can be combined with any one of three different pinion diameters.

6. A method as defined in claim 1 further comprising live steam intake and steam exhaust duct sets of two different standard diameters each for each rotor wheel diameter, each exhaust duct being associated with a respective turbine casing, the diameter corresponding to respectively different standard steam pressure values.

7. A method so defined in claim 1, wherein the plurality of gear casings from which the selected gear casing is taken all have identical retaining recesses and bores for receiving shaft seals and bearings.

8. A method as defined in claim 7 further comprising a pinion shaft connecting said selected pinion to said selected turbine stage assembly, said pinion shaft being selected from a plurality of available pinion shafts all constructed to provide the same dimensions determining the mutual association and positions of components on or around said selected pinion shaft and the position of said selected pinion shaft to said gear casing.

9. A method as defined in claim 8 further comprising oil supply means including an oil supply pipe in parallel with said pinion shaft and bearing seats and an oil sprinkler in communication with said pipe.

10. A method as defined in claim 7 wherein the plurality of turbine casings and the plurality of gear casings all have connecting members with identical dimensions.

11. A method as defined in claim 7 constructed both for horizontal and vertical positioning on appropriately provided horizontal and vertical flanges of the gear housings.

12. A method as defined in claim 7 further comprising: an oil pump; a speed governor; and means connecting said pump and said governor to be driven by said selected turbine stage assembly by means of the gear shaft and an intermediate driving gear.

13. A method as defined in claim 7 further comprising an axial bearing supporting said selected pinion shaft and constructed to be replaceable without opening of said selected gear casing.

* * * * *